United States Patent [19]

Fox

[11] 3,971,450

[45] July 27, 1976

[54] WELL DRILLING TOOL

[75] Inventor: Fred K. Fox, Houston, Tex.

[73] Assignee: Engineering Enterprises, Inc., Houston, Tex.

[22] Filed: Jan. 31, 1975

[21] Appl. No.: 546,006

[52] U.S. Cl. ..... 175/107; 175/228; 175/325; 277/87; 415/502

[51] Int. Cl.[2] ..... E21B 3/12

[58] Field of Search ..... 415/502; 175/107, 104, 175/227–229, 325; 277/77, 87

[56] References Cited

UNITED STATES PATENTS

| | | | |
|---|---|---|---|
| 2,937,008 | 5/1960 | Whittle | 175/107 X |
| 2,990,894 | 7/1961 | Mitchell et al. | 175/107 |
| 3,291,230 | 12/1966 | Cullen et al. | 175/107 X |
| 3,365,202 | 1/1968 | Carleston | 175/107 X |
| 3,540,742 | 7/1967 | Tracy | 277/77 X |
| 3,656,565 | 4/1972 | Fox | 175/325 X |
| 3,659,662 | 5/1972 | Dicky | 175/107 |
| 3,762,724 | 10/1973 | Porter | 277/87 X |
| 3,807,513 | 4/1974 | Kern et al. | 175/107 |

*Primary Examiner*—Ernest R. Purser
*Assistant Examiner*—William F. Pate, III
*Attorney, Agent, or Firm*—Marvin B. Eickenroht; W. F. Hyer

[57] ABSTRACT

There are disclosed several embodiments of a well drilling tool which is adapted to be connected to the lower end of a drill string above the drill bit, and which comprises inner and outer members which are rotated with respect to one another by a motor between them.

38 Claims, 17 Drawing Figures

2A
22
115
105
2B
2A
26
2B
2C
28
24
2D
2C
20
21
28
46
2D
2E
27
28
47
25
2F
2E
23
2F 50
42
48
43
24D
49
50
25
25C
55
45
47
47
34a
3
3
34
44
34a
24E
56
57
58

22
116
117
118
115
115
119
24A
24
109
108
106
105
105

94
92
95
96
91
93
100
101
99
97
98
113
112
114
102
24A
110
111
24B 24B
35
90
82
75
25A
81
24
85
86
36
87
4
4
31
84
83
32
76
80
24C
29
25B
24
38
77
79
37

24C
78
25B
30
39
53
33
33a
24D
52
62
4
61
60
46
42
40
44
51
25C
54

WELL DRILLING TOOL

This invention relates to well drilling tools of the type which is adapted to be connected to the lower end of a drill string above the drill bit, whereby drilling fluid may be circulated downwardly through the inside of the tool and upwardly within the annulus between the outside of the tool and the bore of the well being drilled. More particularly, it relates to improvements in tools of this type which comprise inner and outer members having a motor therebetween for rotating one with respect to the other.

In one such type of tool, the bit is connected to a shaft member which is rotated with respect to a tubular member connected to the lower end of the drill string, whereby the bit may be rotated at a relatively high speed, without rotating the drill string. The motor may be of a fluid type, such as a turbodrill, which is driven by the circulation of drilling fluid through it, or it may be of an electric type.

In another tool of this type, such as that disclosed in U.S. Pat. No. 3,656,565, a shaft member is connected at its opposite ends to the drill string and bit, and a tubular member is arranged about the shaft member and caused to rotate with respect to the shaft member by means of a motor between them. In this latter tool, spiral blades are carried about the tubular member for lifting drilling fluid within the annulus in order to reduce bottom hole pressure within the well bore.

Fluid in the well, particularly drilling mud, contains abrasives which damage thrust bearings mounted in the annular space to support the inner and outer members for relative rotation. When damaged, these bearings must be replaced, which requires raising and lowering the drill string at great expense. In prior tools of this type, efforts have been made to protect the bearings from the damaging effects of the well fluid by containing them in a lubricant chamber formed at least in part by a pair of seals in the annular space.

However, one or both of these seals also functions to separate fluids on the inside and outside of the tool. The necessity of containing this substantial pressure differential, due to the pressure drop across the bit and/or across the fluid motor, eventually causes these seals to leak, and thus permit well fluid to enter the lubricant chamber. The tool shown in U.S. Pat. No. 3,807,513 is typical of prior efforts to solve this problem by improving upon the seals. However, to my knowledge, these prior efforts have not been successful in excluding mud from the lubricant chamber.

It is therefore the primary object of the present invention to provide such a tool wherein the bearings and/or other parts within the lubricant chamber are better protected from the drilling fluid; and, more particularly, wherein such protection is made possible with the use of more or less conventional seals.

These and other objects are accomplished, in accordance with the novel aspects of the present invention, by tools of this type in which any leakage of fluid past the seal which contains the pressure differential is controlled to pass from the inside to the outside of the tool, and each of the seals which form the lubricant chamber merely separate the lubricant from fluid within the chamber which is at substantially the same pressure as the lubricant. In this way, my invention takes advantage of two known phenomena, both of which contribute to a longer usable tool — namely, that a dynamic seal which merely separates fluids at substantially the same pressure will last longer than one which contains a pressure differential, and that a small amount of leakage of drilling fluid from the inside to the outside of the tool will not seriously detract from its effectiveness.

More particularly, several embodiments of such tool are disclosed, each of which includes a first means sealing between the inner and outer relatively rotating members for separating the pressure of fluid on one side — which may be the inside or the outside — of the tool from that within a portion of the annular space between the members, thereby sealing against the above-mentioned pressure differential, and means providing a lubricant chamber which includes second and third means sealing between the members within the space portion, the other side of the tool being fluidly connected with the space portion above and below the second and third sealing means, respectively. More particularly, the volume of the chamber is variable in response to changes in the pressure of fluid on said other side of the tool near the chamber, so as to maintain the pressure of lubricant within the chamber substantially equal to that on the other side of the tool, whereby bearings and/or other parts contained within the chamber are protected from the drilling fluid.

The first sealing means may be above the lubricant chamber, in which case it separates the pressure of fluid on the inner side of the tool from that within a portion of an annular space beneath it, and fluid on the outer side of the tool is fluidly connected with such space portion above and below the second and third sealing means. Alternatively, the first sealing means may be below the lubricant chamber, in which case it separates the pressure of fluid on the outer side of the body from that within a portion of an annular space above it, and fluid on the inner side of the body is fluidly connected with the space portion above and below the second and third sealing means.

The volume of the lubricant chamber may be caused to vary in a number of ways. Thus, in one embodiment of the invention, one or both of the second and third sealing means comprise seal rings which are vertically reciprocable with respect to both members, and thus free to compensate for changes in fluid pressure of the fluid with which they are fluidly connected. In other embodiments of the invention, the second and third sealing means comprises seals which are fixed against longitudinal vertical movement between the members, and the chamber also includes a lubricant reservoir fluidly connected with the part thereof between the second and third seal means, the reservoir being expandible and contractible in response to changes in the pressure of fluid to which the second and third fluid means are fluidly connected. This latter means for varying the volume of the lubricant chamber not only compensates for changes in fluid pressures, but also provides a large supply of lubricant for replacing lubricant which may be lost from the lubricant chamber.

In one of these latter described embodiments, a bellows disposed within the annular space portion is fluidly connected to the part of the lubricant chamber between the second and third seal means. In another such embodiment, the means providing the reservoir comprises passageway means within one member fluidly connected at one end with the side of the tool with which the second and third sealing means are fluidly connected, and piston means sealably slidable within the passageway means.

In the drawings, wherein like reference characters are used throughout to designate like parts:

Figure 1:
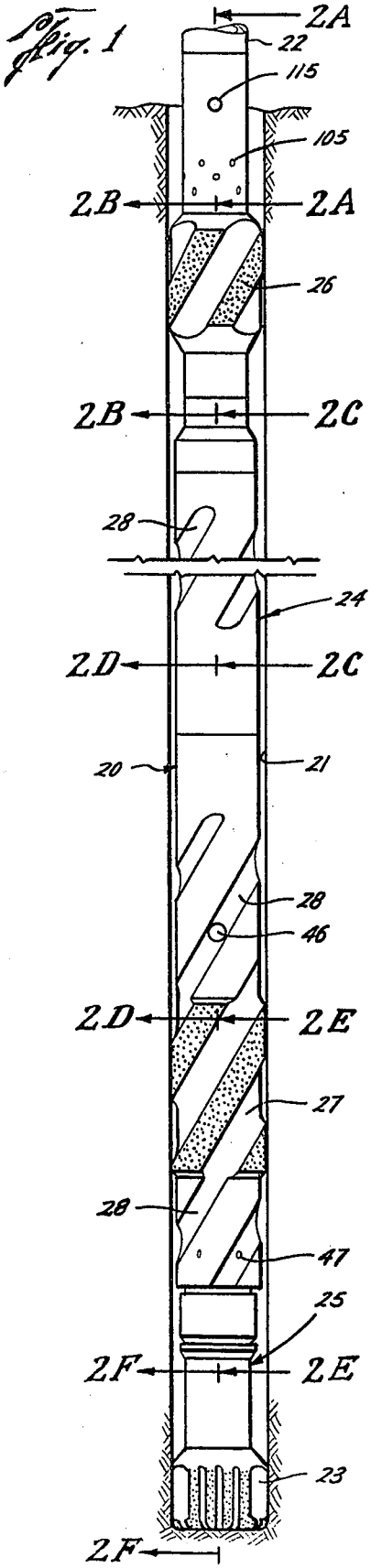
FIG. 1 is an elevational view of a turbodrill constructed in accordance with one embodiment of the present invention and suspended within a well bore, an intermediate portion of its length being discontinued for illustrative purposes.

With reference now to the details of the drawings, the turbodrill constructed in accordance with the firstmentioned embodiment of the invention, and indicated in its entirety by reference character 20, is shown in FIG. 1 to be disposed within a well bore 21, with its upper end suspended from the lower end of a drill string 22 and having a bit 23 suspended from its lower end at the bottom of the well bore. The tool comprises a tubular member 24 having its upper end connected to the drill string, and a shaft member 25 supported concentrically within the tubular member for rotation with respect thereto, with its lower end extending below the lower end of the tubular member and connected to bit 23. As will be described to follow, turbine blades are mounted on the tubular member and shaft member to provide a fluid motor within an annular space between them which rotates the shaft member and thus the bit in response to the flow of drilling mud therethrough as the mud is circulated downwardly through the drill string and tool and out the bit during drilling operations.

As can be seen from FIG. 1, the outer diameter of the bit is larger than the outer diameter of the tool, with the exception of the stabilizer sections 26 and 27 of the tubular member 24, so as to space the remainder of the tool from the well bore. As shown, the stabilizer sections are provided with helical grooves to permit drilling mud to be circulated upwardly therethrough from the bit to surface level. Also, the cylindrical, ungrooved portions of the stabilizer sections are provided with hard facing to minimize wear thereof. Still further, helical grooves 28 are provided in the outer diameter of other portions of the non-rotating tubular member 24 to minimize the likelihood of becoming stuck against the well bore.

Figure 2E:
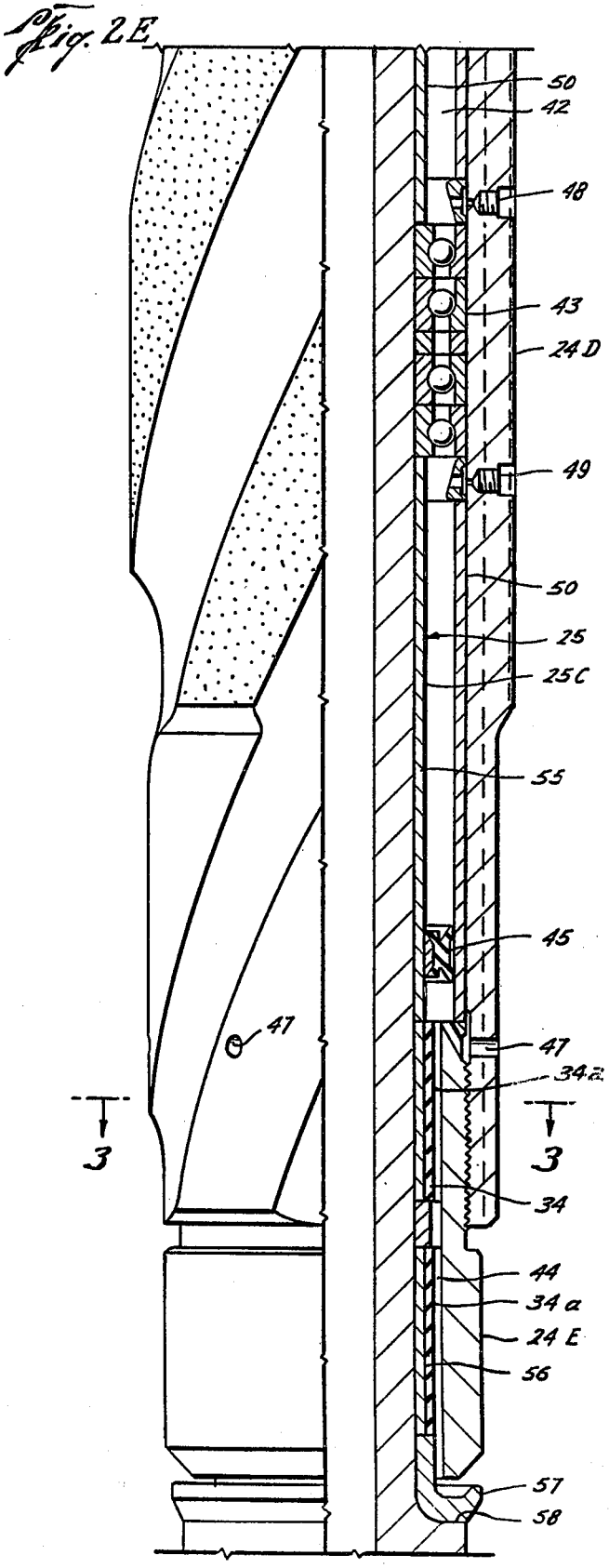
FIG. 2E is an enlarged view of a still further lower portion of the tool, also shown in partial section, as indicated by broken lines 2E—2E of FIG. 1.
Figure 2A:
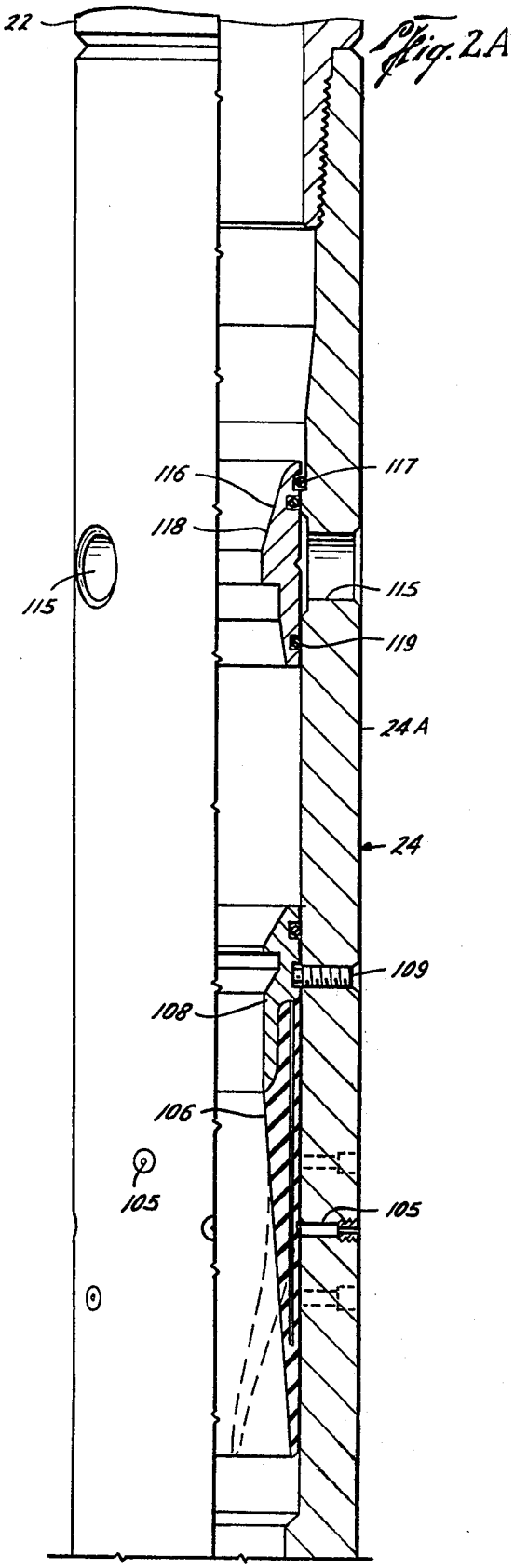
FIG. 2A is an enlarged view of an uppermost portion of the tool, shown partly in vertical section, as indicated by broken lines 2A—2A of FIG. 1.
Figure 2B:
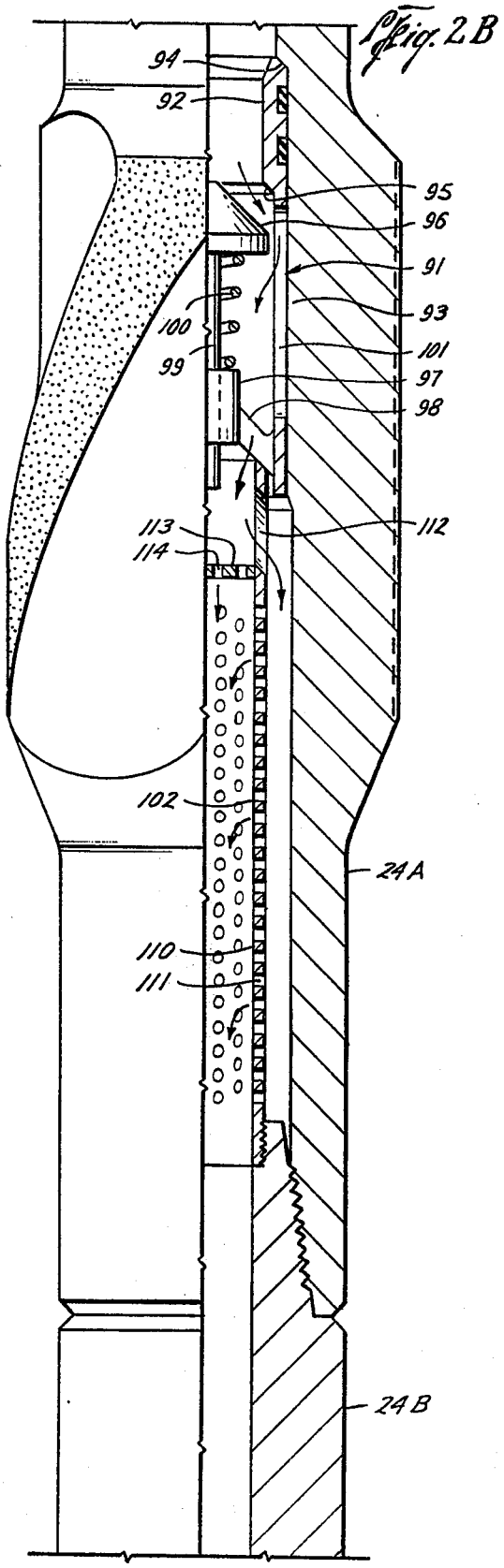
FIG. 2B is an enlarged view of a successively lower portion of the tool, also shown partly in section, as indicated by broken lines 2B—2B of FIG. 1.

The upper end of the tool 20, which is illustrated in FIGS. 2A and 2B, contains means which permit the tool and the drill string above it to be filled with well fluid as they are lowered into the well bore. The intermediate portion of the tool shown in FIG. 2C contains the fluid motor, and is therefore normally of a substantial longitudinal extent. The portion of the tool beneath the fluid motor, and shown in FIGS. 2D and 2E, includes an annular space between the shaft and tubular members in which the abovedescribed seals and bearings are contained. The lowermost end of the tool shown in FIG. 2F includes the lower end of the shaft member which is connected to the bit 23.

With reference now to the details of the sectional views, the tubular member 24 is shown in FIGS. 2A — 2B to be made up of an uppermost tubular section 24A threadedly connected to the lower end of the drill string 22 and extending downwardly to a connection at its lower end to a next lower tubular section 24B. The latter section is in turn connected at its lower end to a tubular section 24C shown in FIG. 2C and the top of FIG. 2D to comprise the outer housing for the fluid motor of the tool. The lower end of the section 24C is in turn connected to the upper end of the next lower section 24D, which is shown in FIGS. 2D and 2E to comprise the outer housing for the thrust bearings. As shown in FIG. 2E, the lower end of the section 24D is connected to a lower tubular section 24E from which the lower end of the shaft member 25 extends.

Figure 2C:
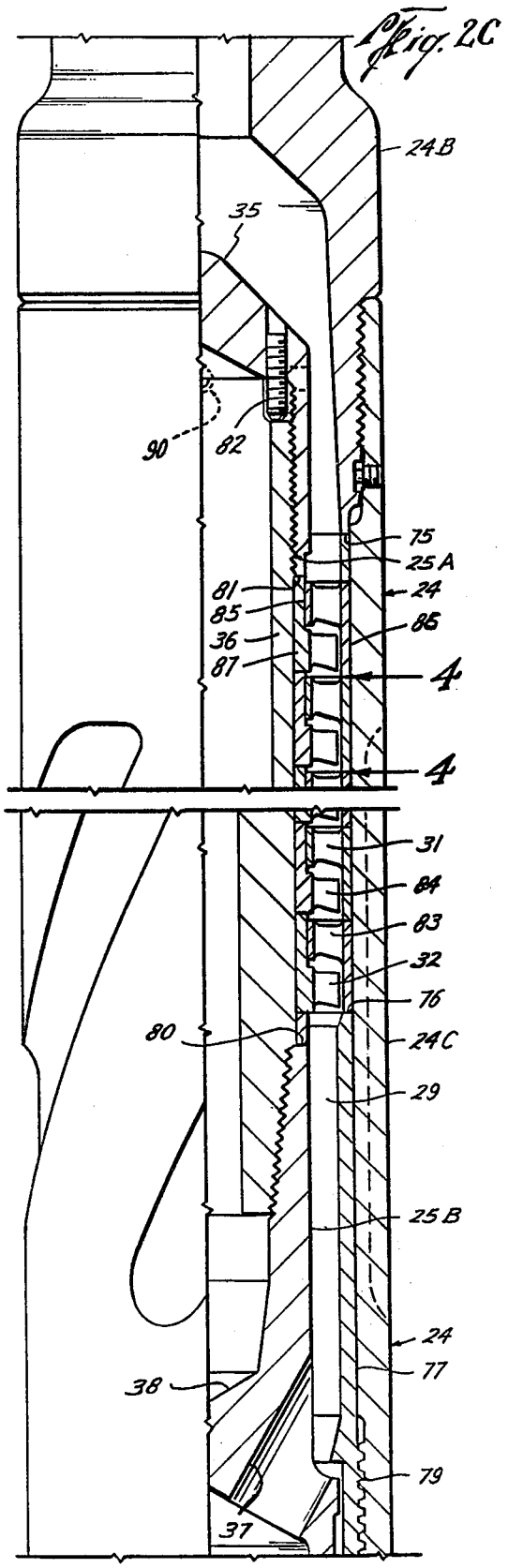
FIG. 2C is an enlarged view of the discontinuous intermediate portion of the tool immediately beneath the portion shown in FIG. 2B, and also shown partly in vertical section, as indicated by broken lines 2C—2C of FIG. 1.
Figure 2D:
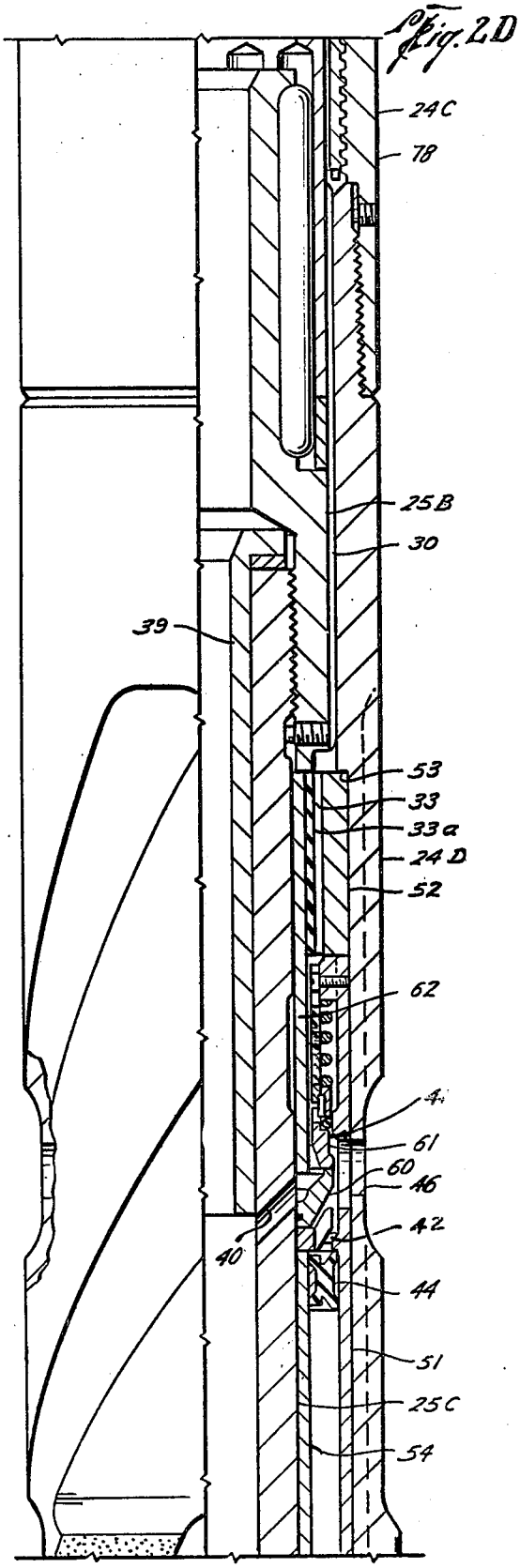
FIG. 2D is an enlarged view of the next lower portion of the tool, also shown partly in section, as indicated by broken lines 2D—2D of FIG. 1.
Figure 2F:
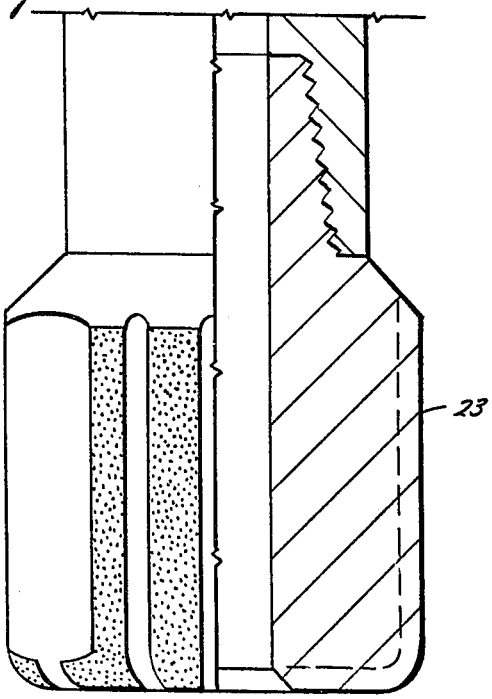
FIG. 2F is still another enlarged view of the lower end of the tool, also shown partly in section, as indicated by broken lines 2F—2F of FIG. 1.

The shaft member 25 is also made up of a plurality of interconnected tubular sections, including an uppermost section 25A which is shown in FIG. 2C to extend downwardly within the tubular section 24C of the tubular member 24 to form an upper annular space for the fluid motor. The lower end of the section 25A is in turn connected to a section 25B which extends downwardly through the lower end of tubular member section 24C and the upper end of tubular member section 24D. The lower end of tubular section 25B is in turn connected to the upper end of a tubular section 25C which, as shown in FIGS. 2D and 2E, extends within the tubular section 24D of the tubular member 24 to form a lower annular space for the thrust bearings and seals. The lower end of section 25C of the shaft member extends downwardly through the lowermost section 24E of the tubular member for threaded connection at its lower end to the drill bit, as shown in FIG. 2F.

As shown in FIGS. 2C and 2D, the upper annular space provides a relatively large fluid passageway section 29 above a passageway section 30 of smaller cross-sectional area. As also shown in FIG. 2C, a series of stator elements 31 are mounted on the section 24C of the tubular member, and a plurality of rotor elements 32 are mounted on the section 25A of the shaft member 25 to provide a multi stage turbine in the passageway section 29.

Figure 3:
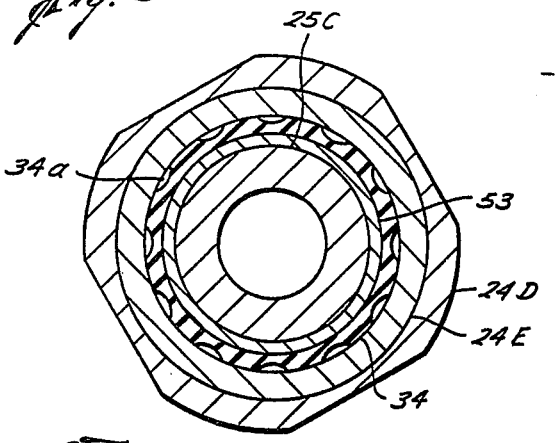
FIG. 3 is a cross-sectional view of the tool, as seen along broken lines 3—3 of FIG. 2E.

As shown in FIG. 2C, and as will be described more fully hereinafter, the stator elements 31 have bearing surfaces which provide radial bearings for the rotor elements 32 and thus for the shaft member. Additional radial bearings are provided by sleeves 33 (FIG. 2D) and 34 (FIG. 2E) carried on the outer diameter of the shaft member for sliding within the inner diameter of the tubular member. Each such bearing sleeve has grooves therein, shown at 33*a* in the sleeve 33 and at 34*a* (FIG. 3) in the sleeve 34 to permit drilling mud to circulate therethrough, for purposes which will be apparent from the description to follow.

Drilling mud circulating downwardly through the drill string, and thus into the upper end of the tubular member 24, is diverted into the upper passageway section 29 by means of a cap 35 threadedly connected to and across the open upper end of a hollow portion 36 formed in the shaft member sections 25A and 25B. Upon flow downwardly through the passageway portion 29, most of the drilling mud passes through large ports 37 in shaft section 25B, and thus into the interior of the shaft section 25B below the lower closed end 38 of hollow portion 36, for circulation downwardly to the drill bit.

The bore of section 25C of the shaft member is reduced below ports 37 by means of a sleeve 39, and additional ports 40, which are considerably smaller than the ports 37, are provided in the tubular section 25C of the shaft member below the sleeve. A face seal assembly, which is designated in its entirety by reference character 41, is shown in FIG. 2D to form a sliding seal between the shaft member and tubular member, and particularly between tubular member section 24D and shaft member section 25C, and thereby close the lower end of passageway 30. This confines drilling mud to flow through ports 40 into the interior of the shaft member section 25C, where it is combined with the more substantial flow of mud through the ports 37 for circulation to the drill bit.

As also shown in FIGS. 2D and 2E, seal assembly 41 also separates fluid within the upper annular space provided by passageways 29 and 30 — and thus on the inner side of the tool — from that within a lower annular space 42 formed between the shaft member and tubular member. As shown in FIG. 2E, thrust bearings 43 are disposed within this lower space to support the shaft member and tubular member for relative rotation. More particularly, the bearings are contained within a lubricant chamber which is defined vertically between upper and lower seal rings 44 and 45 mounted for sliding vertically between the shaft member and tubular member.

Ports 46 are provided in the tubular section 24D to fluidly connect the lower space 42 intermediate above seal ring 44 with drilling mud on the outer side of the tool. Drilling mud on the outer side of the tool is also fluidly connected to lower space 42 beneath seal ring 45 through ports 47 in the tubular section 24D as well as through grooves 34a in bearing sleeve 34 leading to the open lower end of the tubular section 24E. Thus, seal assembly 41 separates high fluid pressure on the inner side of the tool from the low fluid pressure on its outer side, and the seal rings 44 and 45 separate lubricant in the chamber between them from essentially the same pressure on the outer side of the tool. More particularly, since the seal rings are free to slide vertically, they will compensate for changes in such pressure, relative to the pressure within the lubricant chamber, and compensate for loss of any lubricant from the chamber due to leakage.

Although there may be some leakage of drilling mud from the inside to the outside of the tool past the seal assembly 41, such leakage will not affect this isolation of the lubricant chamber from drilling mud. Furthermore, and as previously mentioned, the small amount of leakage which might occur through the seal assembly is normally of no great consequence so far as the efficiency of the tool is concerned. That is, the seal assembly 41 will in any event be adequate to divert substantially all of the drilling mud within the passageway portions 29 and 30 to the bit 23.

As shown in FIG. 2E, the thrust bearings 43 are of conventional ball bearing type, with the lowermost race being supported on an upwardly facing shoulder on the interior of the tubular member, and the innermost race in turn supporting a downwardly facing shoulder on the shaft member. Thus, the bearings are mounted between a lower sleeve 50 resting on the upper end of tubular section 24E, and an upper sleeve 51 held down on the top of the bearings by a spacer 52, which in turn is held down by a downwardly facing shoulder 53 on the inner diameter of tubular section 24D (see FIG. 2D) in a position opposite radial bearings 33. A sleeve 54 about the shaft member is held down on the top bearing by the seal assembly 41, and additional sleeves 55 and 56 extend downwardly along the outer diameter of shaft member section 25C beneath the thrust bearings and within radial bearing 34. The lower end of sleeve 56 is supported on a cup 57 which is in turn supported on a shoulder 58 on the enlarged lower end of the tubular section.

Figure 5:
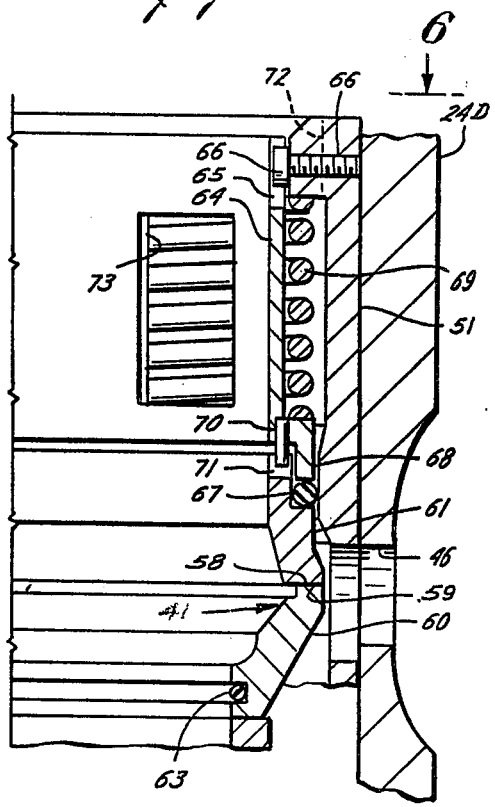
FIG. 5 is an enlarged, partial view of the part of the tool shown in section in FIG. 2D with a portion of the shaft member removed therefrom for purposes of illustration.

The seal assembly 41 includes seal ring 60 carried on the shaft member and having an upwardly facing, horizontally disposed seal surface 58, and a seal ring 61 carried by the tubular member and having a downwardly facing horizontally disposed seal surface 50 for sliding over the seal surface 58. As shown in FIG. 2D, the seal ring 60 is mounted for rotation with the tubular section 25C of the shaft member by means of a sleeve 62 disposed within the bearing sleeve 33 and held down by a downwardly facing shoulder on the lower end of shaft member 25B. Also, and as best shown in FIG. 5, a seal ring 63 is carried in a groove on the inner diameter of the seal ring 60 for sealing with respect to the outer diameter of shaft member section 25C. The seal ring 60 is cup-shaped so as to facilitate free passage for drilling mud beneath the lower edge of the sleeve 62 into the ports 40.

As best shown in FIG. 5, the seal ring 61 is yieldably held down against the seal ring 60 by means of a sleeve 64 which is vertically slidable within the annular passageway 30. The upper end of the sleeve 64 is slotted at 65 for guidably sliding over the head of a screw 66 fixed to the upper end of sleeve 51. A flange 68 on the lower end of the sleeve 64 is held down against an O-ring, which in turn is held down against an outer shoulder on the seal ring 61. More particularly, the sleeve 64 is urged downwardly by means of a coil spring 69 disposed between it and the inner diameter of the sleeve 51.

Figure 6:
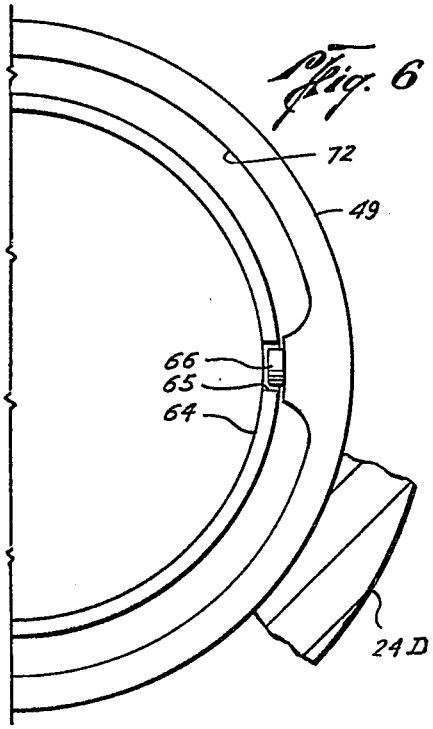
FIG. 6 is a cross-sectional view of the part of the tool just above FIG. 5, as seen along broken lines 6—6 of FIG. 5.

The seal ring 61 is held from rotating with respect to the sleeve 64, and thus with respect to the tubular member, by means of pins 70 which extend downwardly from the sleeve into slots 71 in the upper edge of seal ring 61. As will be understood from the foregoing, the spring 69 cooperates with the sleeve 64 in not only yieldably holding the seal ring 61 in engagement with the seal ring 60, but also causing a seal ring 67 to seal between the seal ring 61 and the sleeve 51. As shown in FIG. 2D, the inner diameter of the sleeve 64 is spaced from the sleeve 62 of the shaft member, and from the lower end of the bearing sleeve 33, to form a continuation of passageway 30 for drilling mud flowing downwardly past the seal assembly 41 and into the ports 40. As best shown in FIGS. 5 and 6, the upper enlarged end of the sleeve 51 has grooves 72 therein, and windows 73 are formed within the sleeve 64, so as to enlarge the area through which drilling mud may flow.

As also previously described, the circulation of drilling fluid through the passageway section 30 and thus past the sleeve 64 of the seal assembly will cool the sealing surfaces between the seal rings 60 and 61 and thus extend the normal useful life of seal assembly 41. Also, this particular face seal construction will permit the sealing faces of the seal rings to maintain substantial sealing contact with one another despite slight misalignment of the tubular member and shaft member. Furthermore, the seal rings 60 and 61 are formed separately from the other parts of the shaft member and tubular member so that they, or at least their sealing surfaces, may be made of a very hard material having high resistance to wear and thus abrasion due to drilling mud.

As shown in FIGS. 2C and 2D, the stator elements 31 of the fluid motor are stacked between and held for rotation with the tubular member by a downwardly facing shoulder 75 on the lower end of tubular section 24C and an upwardly facing shoulder 76 on the upper end of a sleeve 77 of the tubular section 24C, which is connected to an outer body 78 thereof by means of acme threads 79. As shown in FIG. 2C, the rotor elements 32 are stacked above a spacer on an upwardly facing shoulder 80 of the upper end of tubular section 25B of the shaft member, and are held down and thus prevented from rotating with respect to the shaft member by a downwardly facing shoulder 81 on the cap 35, which is threaded to tubular section 25A. As will be apparent from the drawings, disconnection of sleeve 77 and tubular section 25B will permit the turbine elements to be assembled and then held with a desired endwise force. A threaded pin 82 will then lock the cap in desired position.

Figure 4:
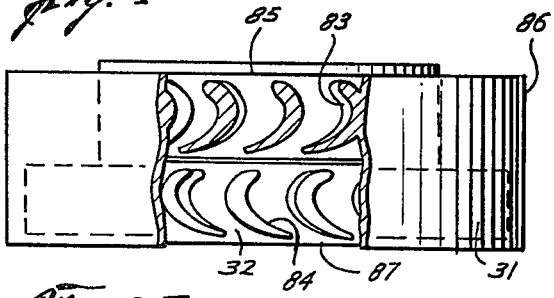
FIG. 4 is an enlarged detailed view of a pair of rotor and stator turbine elements removed from the fluid motor of the tool, and with the rotor element broken away in part for purposes of illustration.

As well known in the art, and as shown in FIG. 4, each of the rotor and stator elements has a blade 83 and 84, respectively, which is cup-shaped and angled with respect to the blade of the other so as to cause rotation of the rotor elements and thus the shaft member with respect to the stator elements and thus the tubular member. Each of the stator elements also includes inner and outer rings 85 and 86, respectively, between which the blades 83 extend, with the outer sleeves 86 being stacked one above the other to space the stages. The blades and inner sleeve of each stator extend inwardly of only the upper half thereof so that the blade 84 of the rotor may be received in the lower half thereof, and the inner circumference on the sleeve 85 provides a radial bearing for the outer circumference of an inner ring 87 of each rotor. Thus, the blade 84 of each row extends from only the lower end of ring 87 beneath the blade 83 of the stator to a position close to the inner diameter of the lower end of ring 85. As in the case of the stator elements, these inner rings 87 of the rotor elements bear against one another so as to space the stages.

In the preferred embodiment of this invention, while the rotor elements are formed of stainless steel, the stator elements are formed of beryllium copper, which provides an excellent bearing surface for the rotating surface of each rotor element. Also, as shown, these bearing surfaces are formed on the inner diameters of the stator elements so as to reduce the velocity of sliding contact between the stators and rotors. Since beryllium copper has a relatively low melting point and high fluidity, it is more easily castable than conventional turbine element materials, and full advantage is taken of this characteristic by virtue of the fact that the more intricately shaped stator element is formed of this material. However, other materials having characteristics similar to beryllium copper may be used, and these include copper, silver, gold, platinum and lead, and their alloys. Also, this invention contemplates that the bearing surface on the inner ring 85 of each stator element may only be coated with this material.

As best shown in FIG. 2C, ports 90 are formed in the cap above the upper end of the section 25C of the shaft member to permit the upper hollow portion 36 of the section to fill with drilling mud. Thus, although the imperforate upper end of the cap 35 will divert the flow of drilling mud downwardly through the tubular member section 24B into the passageway section 29 for flow through the fluid motor, drilling mud will, upon filling the passageway section, flow through the ports 90. As shown this hollow portion extends from the cap 35 to a closed lower end 38 just above the ports 37, with its walls being thinnest at its upper end and thickest at its lower end, at least for that portion of its length between the upper and lower ends of the fluid motor. For this purpose, and as will be obvious from FIG. 2C, the hollow portion is stepped along its length, although it may be cylindrical or tapered.

As shown in FIG. 2B, a cage 91 is mounted in the bore through section 24A of the tubular member 24 to support a closure member 96 in position to open and close the bore through each member above the fluid motor. The cage includes a sleeve 92 at its upper end which is held against a shoulder 94 in the bore to provide a seat 95 across the bore with which the closure member 96 is engageable to close the bore. The cage is supported in this position by the engagement of its lower end with the upper end of a screen 102, and the screen is in turn supported on the tubular member by connection at its lower end to the upper end of tubular section 24B.

The lower end of the sleeve of the cage supports a collar 97 by means of ribs 98 extending between it and the collar, and a stem 99 extending downwardly from the closure member 96 is vertically slidable within the collar. Coil spring 100 surrounds the stem 99 and bears between the upper end of the collar and the lower end of the closure member to normally urge the closure member upwardly to closed position. As shown in FIG. 2B, the upper surfaces on the closure member are downwardly and outwardly tapered, so as to define a conically shaped opening between them and the seat 95 when the closure member is moved to the open position shown in FIG. 2B. Also, the sleeve of the cage is open between vertical ribs 101 to facilitate the free flow of drilling and downwardly therethrough past the closure member.

As will be appreciated, when the tool is being run into the well bore, the closure member 96 is urged upwardly to closed position, which prevents well fluid from circulating upwardly through the tool. Although the closure member is located above the fluid motor, it will permit only a relatively small amount of well fluid to pass through the motor as the well fluid fills the lower end of the tool. Therefore, there is little likelihood of cuttings or other debris in the well fluid becoming clogged in the fluid motor.

In order to avoid the necessity of filling the tool and the drill string thereabove as they are made up at surface level, a means is provided for permitting well fluid to fill the upper end of the tool above the closure member 96, and thus the drill string thereabove, automatically in response to lowering of the tool into the well bore. More particularly, this means comprises a series of ports 105 formed in the section 24A of the tubular member above the closure member, and a generally cylindrical sleeve 106 of rubber which is supported in the bore of the tubular section 24A in a position to normally cover the inner ends of the ports 105. The upper end of the rubber sleeve is secured about a metal ring 108 which is supported within the bore of the section 24A by means of a screw 109. However, the lower end of the sleeve is free to deflect inwardly, as indicated by the dotted lines in FIG. 2A, in response to a differential between the fluid pressure of the drilling mud externally of the tool and the well fluid within the tool. Thus, as the tool is lowered in the well bore, the sleeve will be urged to port opening position to permit well fluid to flow through the ports 105 and thus fill the tool above the closure member 96.

When the tool has thus been lowered to cause the bit 23 to engage the lower end of the well bore, drilling mud which is circulated downwardly through the drill string and the upper end of the tool will expand the sleeve 106 to its closed position and lower the closure member 96 to open position and then flow through the annular passageways for operating the fluid motor. The orifice through each of the ports 105 is relatively small, and preferably no greater in diameter than the smallest dimension of the smallest opening through the turbine blades, which is the smallest restriction through the tool, so that even though well fluid which has been admitted to the tool will be forced through the motor, it will contain few if any cuttings or other debris which would clog the motor. This will be true even if the orifices are larger than the smallest openings through the turbine blades, because particles which might pass through the orifices would normally be ground up by the circulation of fluid through the rotating blades.

As shown in FIG. 2B, the screen 102 includes a cylindrical portion 110 spaced inwardly of the surrounding bore of section 24A and having a plurality of relatively small holes 111 therein, and an upper end above the holes having enlarged ports 112 therethrough. It also includes a lateral section 113 which is disposed across the cylindrical portion 110 just beneath the ports 112 and has relatively small holes 114 therein, of generally the same size as the holes 111. All of the holes 111 and 114 are preferably of a size, similarly to the ports 105, no greater than the smallest dimension of the smallest opening through the fluid motor, so that cuttings or other debris in the drilling mud which would otherwise clog the fluid motor will be trapped by the screen 102 on the upstream side of the fluid motor. Here again, however, larger particles in the mud would, in any case, be subject to the grinding action of the rotating blades. The annular space defined between the cylindrical portion 110 and the oppositely facing bore through the section 24A of the tubular member is sufficiently large to receive a large volume of such cuttings, without the need for pulling the tool.

As shown in FIG. 2A, one or more relatively large ports 115 are provided in the tubular section 24A of the tubular member above the sleeve 106. These ports are normally closed by a sleeve 116 supported in the bore by means of an O-ring 117. The outer portion of the O-ring is seated upon an upwardly facing shoulder on the bore of the tubular section 24A, while the inner portion of the O-ring is supported within a shallow groove on the outside of the sleeve 116. The sleeve has an upwardly facing tapered seat 118 onto which a ball (not shown) may be dropped so as to close the bore through the tubular section 24A. This permits fluid pressure to be applied above the ball for the purpose of shearing the ring 117, so as to permit the sleeve 116 to be moved downwardly to open the ports 115. This may be desirable, for example, in the event it is necessary during a drilling operation, to circulate a large volume of lost circulation material into the annulus of the well bore. Opening of the ports 115 permits this circulation to be accomplished more readily than would be possible if it were necessary to do so through the fluid motor and other restrictions in the tool beneath the ports 115. The lower end of the sleeve carries an O-ring 119 for engaging about the bore of the section 24A below the ports 115, so as to seal off the sleeve above and below the ports 115 when it is in the closed position shown in FIG. 2A.

Figure 7A:
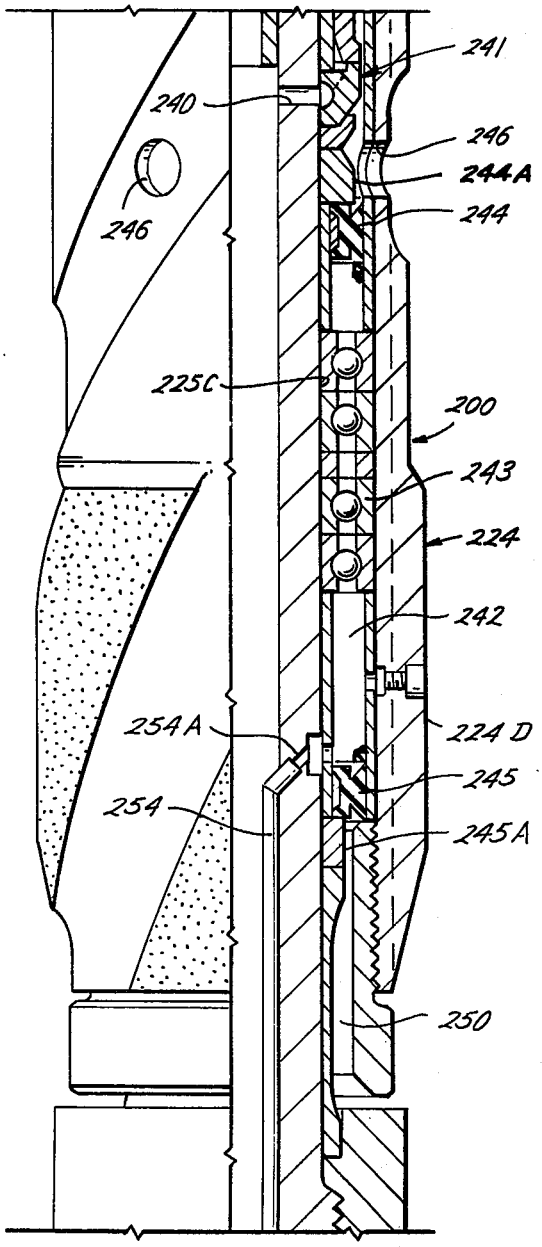
FIGS. 7A and 7B are views, partly in elevation and partly in section, of successively lower portions of a turbodrill constructed in accordance with another embodiment of the present invention.
Figure 7B:
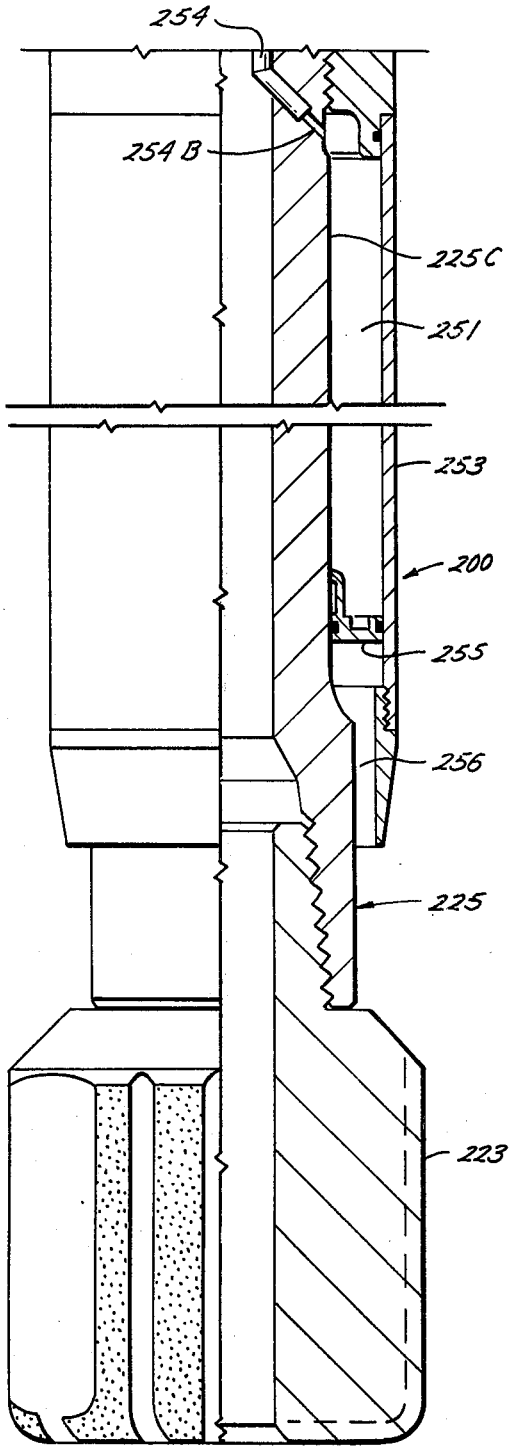

As previously mentioned, only the lower portion of a turbodrill constructed in accordance with the second embodiment of the present invention is shown in FIGS. 7A and 7B, the upper portion of this tool, which is indicated in its entirety by reference character 200, being identical to the corresponding portion of the tool 20 described in connection with FIGS. 1 to 6. Thus, as shown in FIGS. 7A and 7B, tool 200 includes a tubular member 224 arranged concentrically about the lower tubular section of a shaft member 225, with the upper end of the tubular member 224 being suspended from the lower end of a drill string (not shown), and the lower end of a shaft member 225 being connected to a drill bit 223. As also described in connection with tool 20, the shaft member is supported from the tubular member by means of bearings 243, and tubular member 224 is spaced from shaft member 225 so as to provide an upper space which forms an annular passageway (not shown) through which drilling mud may be circulated downwardly through turbine blades (not shown) mounted on the members so as to rotate the shaft member and thus the bit with respect to the tubular member.

As shown in FIG. 7A, a face seal assembly 241, which may be identical to the seal assembly 41 of the tool 20, seals between the tubular member and shaft member beneath the turbine section so as to restrict the flow of substantially all of the drilling mud within the annular passageway through the ports formed in tubular portion 225C of the shaft member for flow downwardly within such portion to the bit 223. As also shown in FIG. 7A, the lowermost portion 224D of the tubular member extends downwardly about shaft member portion 225C so as to define a lower annular space 242 between the tubular and shaft members below the seal assembly 241. As in the first embodiment, thrust bearings 243 are mounted on the shaft and tubular members within space 242, and seal rings 244 and 245 are mounted in fixed vertical positions between such members above and below the bearings to contain lubricant. However, as will be described, the part of the annular space between the seal rings forms only part of a lubricant chamber.

As in the case of the tool 20, ports 246 are formed in tubular member portion 224D so as to fluidly connect fluid pressure on the outer side of the tool with space 242 above seal ring 244, and the lower end of tubular portion 224D is open to fluidly connect fluid pressure on the outer side of the tool with such space beneath seal ring 245. Thus, as described in connection with the tool 20, seal assembly 241 separates high fluid pressure on the inner side of the tool from the lower pressure on the outer side of the tool, so as to contain the pressure differential thereacross, while the seal rings 244 and 245 defining part of the lubricant chamber are subject to essentially equal fluid pressure on the outer side of the tool.

The upper end of seal ring 244 engages ring 244A about shaft member 225 beneath seal assembly 241, and the lower end of seal ring 245 engages ring 245A thereabout. As shown in FIG. 7A, the upper ring is held against downward movement and the lower ring is held against upward movement by shoulders on the tubular member. The lubricant chamber also includes a reservoir within an annular passageway 251 formed in the shaft member between shaft member portion 225C and a tubular extension 253 connected about its lower end beneath the lower end of tubular member portion 224D, and a tube 254 extending within the bore of shaft member portion 225C and connecting at opposite ends with ports 254A and 254B in portion 225C.

The lower end of the reservoir is closed by annular piston 255 sealably slidable within the passageway, and the lower end of the passageway beneath the piston fluidly connects with fluid pressure on the outer side of the body through an annular space 256 between the lower ends of shaft member portion 225C and tubular extension 253. For reasons previously described in connection with tool 20, piston 255 insures that, under ordinary circumstances, the pressure of lubricant within the lubricant chamber will be substantially equal to that on the outer side of the chamber and of the tool, and that lubricant lost from the upper part of the chamber is replaced. As shown, FIG. 7B is vertically discontinuous, illustrating that reservoir 251 may be of substantial length in order to provide replacement lubricant of sufficient volume to permit the tool to be run for long periods of time without being raised from the well bore.

Figure 8:
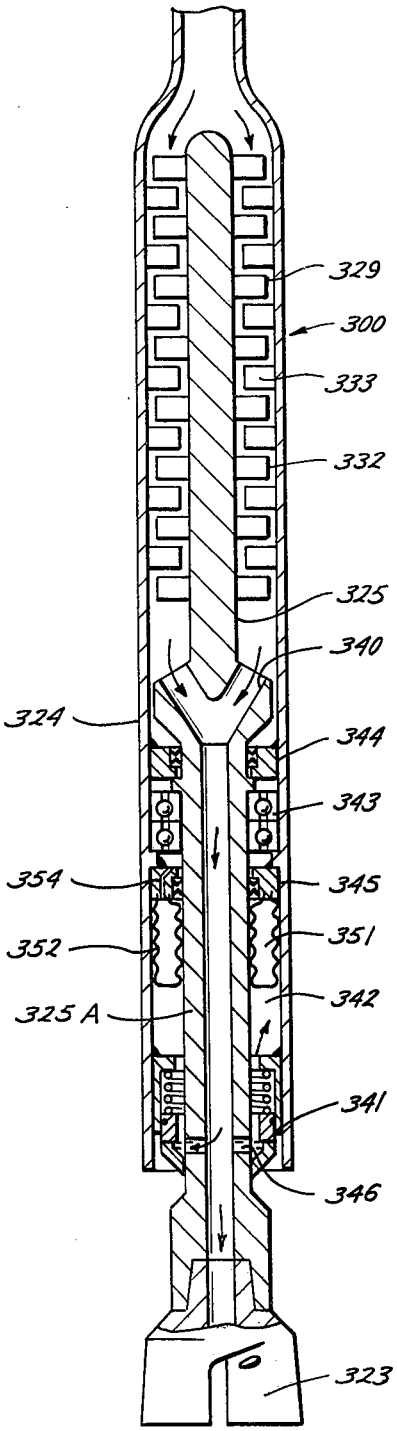
FIG. 8 is a diagrammatic, vertical sectional view of a turbodrill constructed in accordance with still another embodiment of the present invention.

The turbodrill constructed in accordance with the third embodiment of the invention, and indicated in its entirety by reference character 300 in FIG. 8, is similar to the tools 20 and 200 in that it comprises a shaft member 325 arranged concentrically within a tubular member 324, with the tubular member connected to the lower end of the drill string (not shown), and the shaft member connected to a drill bit 323 at its lower end, in this case of the "fish tail" type. As in the case of the prior tools, the shaft member, and thus the drill bit, are supported from the tubular member, and thus the drill string, by means of thrust bearings 343 within a lower annular space 342 between the members, and are caused to rotate with respect to the tubular member by means of a turbine section located within an annular space between the members forming an annular passageway for drilling mud.

Thus, as shown diagrammatically in FIG. 8, the upper end of the shaft member is closed, and turbine blades 332 and 333 are mounted in alternating fashion on the shaft members and tubular members, respectively, whereby the flow of drilling mud through the passageway will cause the shaft member to rotate with respect to the tubular member. As is also the case of the tools 20 and 200, ports 340 are formed in the shaft member to connect the lower end of passageway 329 with a tubular section 325A of the shaft member which extends downwardly to the bit, and means are provided for restricting substantially all of the flow of drilling mud through the ports 340 and the tubular section of the shaft member to the bit 323.

As is also the case of the tools 20 and 200, three sealing means are provided between the shaft and tubular members below the turbine section — namely, a face seal assembly at one end of the lower annular space disposed above and below thrust bearings 343 to contain lubricant. In the tool 300, however, the seal assembly 341 is beneath the thrust bearings 343 near the lower end of the lower annular space, and thus beneath the part of the lubricant chamber formed between seal rings 344 and 345. Consequently, the seal assembly separates fluid pressure on the outer side of the tool from that within the portion of the lower annular space above it. Also, upper seal ring 344 separates the lower annular space from the passageway 342 and thus is fluidly connected with and diverts drilling mud on the inner side of the tool into ports 340. In view of this reversal of the vertical arrangement of the seal assembly and thrust bearings, ports 346 are formed in the shaft member 325 to connect the lower annular space intermediate seal assembly 341 and seal ring 345 with the inner side of the tool. Thus, as in the case of the prior tools, the seal assembly 341 separates fluid pressures on the inner and outer sides of the body, and thus contains the pressure differential thereacross, and the seal rings 344 and 345 which define the lubricant chamber are subject to essentially the same pressure — in this case, that on the inner side of the tool.

Each of the seal rings 344 and 345 is fixed, thereby maintaining a fixed volume within the part of the lubricant chamber between them, and the lubricant chamber includes a reservoir connected with the part of the lubricant chamber formed between seal rings 344 and 345. Furthermore, the reservoir is of a variable volume for maintaining lubricant at a pressure at least as high as that of fluid pressure on the inner side of the tool, with which seal rings 344 and 345 are fluidly connected. Thus, as shown in FIG. 8, a bellows 352 is disposed within the lower annular chamber between seal ring 345 and seal assembly 341, with its upper end suspended from seal ring 345 and connected to a port extending therethrough to the lower end of the part of the lubricant chamber between seal rings 344 and 345. As in the other tools, if there is leakage past seal rings 344 and 345, the bellows will contract to replace the lost lubricant.

Figure 9:
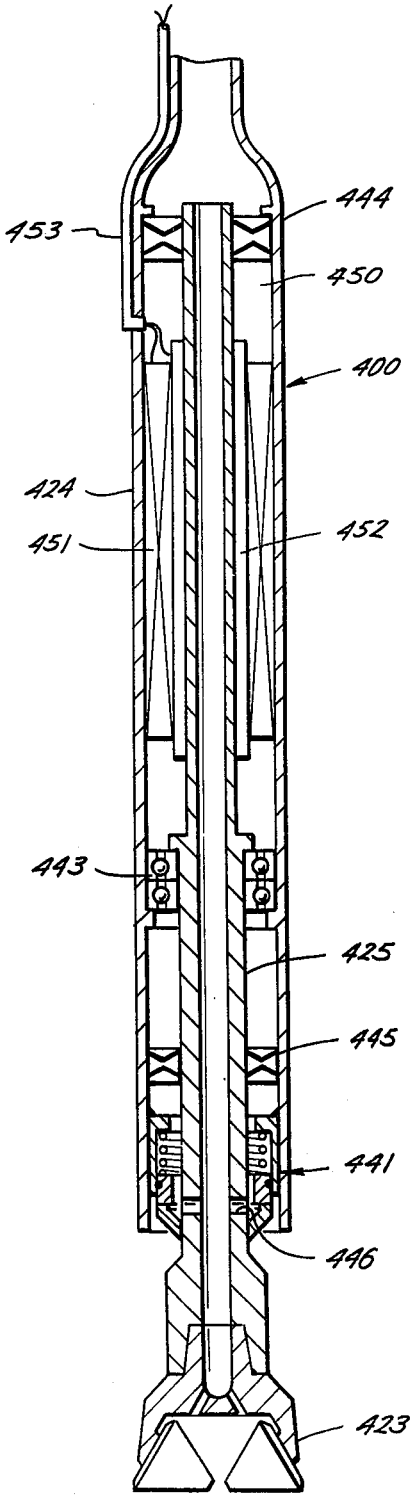
FIG. 9 is a diagrammatic vertical sectional view of another drilling tool constructed in accordance with a still further embodiment of the present invention.

Although not a turbodrill, the tool constructed in accordance with the fourth embodiment of the invention, and indicated in FIG. 9 by reference character 400, is similar in many respects to the previously described tools 20, 200 and 300. Thus, it includes a tubular member 424 suspended from the lower end of a drill string (not shown), and a shaft member 425 arranged concentrically within the tubular member and connected at its lower end to a drill bit 423, with the shaft member being supported for rotation within the tubular member by means of thrust bearings 443 mounted in the lower portion of an annular space 450 between the members. Also, substantially all of the drilling mud circulating downwardly through the drill string, and thus into the tubular member, is restricted to flow into the open upper end of the shaft member and thus to bit 423.

As compared with the prior described tools, however, shaft member 425 is caused to rotate with respect to the tubular member 424 by means of an electric motor comprising parts mounted on the members within space 450. These include, as indicated diagrammatically in FIG. 9, a stator 451 mounted on the inner diameter of tubular member 424, and a rotor 452 mounted on the outer diameter of shaft member 425. Electrical power for activating the motor is supplied thereto by means of a cable 453 extending upwardly along the drill string and tubular member.

As in the prior described tools, there are three sealing means between the shaft and tubular members, including a face seal assembly 441, which may be identical to seal assembly 41 of tool 20, at one end of the annular space, and seal rings 444 and 445 above and below the bearings to contain lubricant in the part of the space between them. Also, as in the case of the tool 300, the seal assembly 441 is near the lower end of the annular space, and thus beneath the thrust bearings, and the lubricant chamber formed between seal rings 444 and 445. Consequently, seal assembly 441 separates fluid pressure on the outer side of the tool from that within the portion of space 450 above it. Also, upper seal ring 444 separates this portion of the annular space from that above it and thus is fluidly connected with diverted drilling mud on the inner side of the tool for flow through shaft member 425. As previously described, and as illustrated in FIG. 9, the motor parts 451 and 452 as well as thrust bearings 443 are vertically between seal rings 444 and 445 and thus contained within lubricant in the chamber so as to be protected from well fluid.

Seal rings 444 and 445 are similar to corresponding parts of the tool 20 in that they are vertically slidable with respect to both the shaft member and tubular member and form the entire lubricant chamber therebetween. However, since seal assembly 441 is beneath the lubricant chamber, ports 446 are formed in the shaft member to connect the annular space between lower seal ring 445 and assembly 441 with the inner side of the tool. Thus, as in the case of the tool 300, seal assembly 441 separates fluid pressure on the inner side of the tool from that on the outer side of the tool and thus contains the pressure differential thereacross. At the same time, the seal rings 444 and 445 defining the lubricant chamber are subjected to essentially the same fluid pressure on the inner side of the tool, so that they will vary the volume of the chamber to compensate for changes therein and maintain the pressure of lubricant substantially equal to that on the inner side of the tool.

Figure 10A:
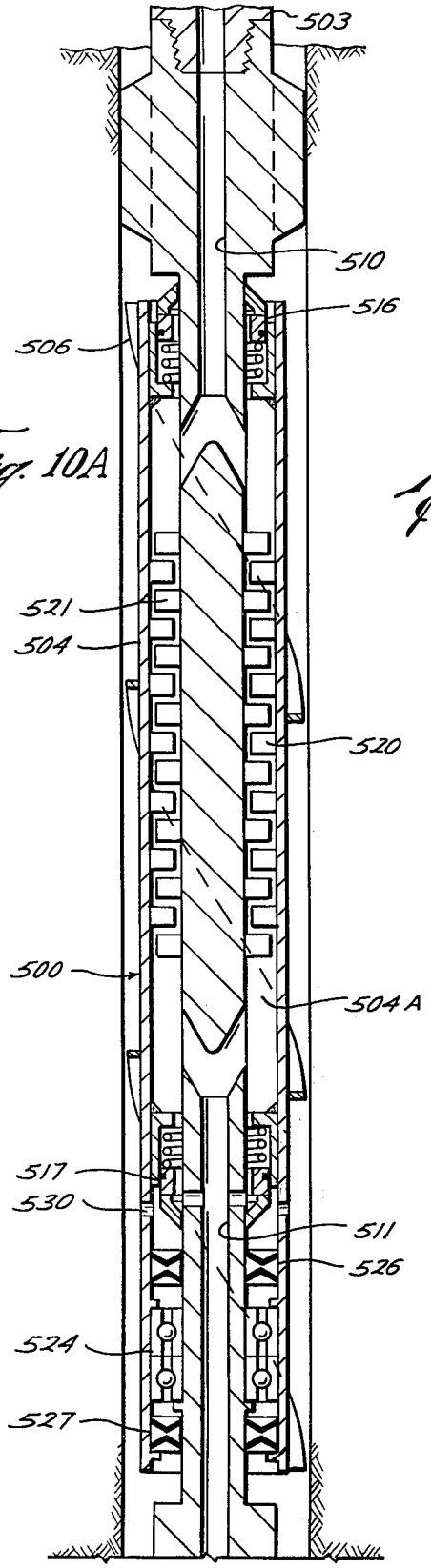
FIGS. 10A and 10B are diagrammatic vertical sectional views of the upper and lower portions of still another drilling tool constructed in accordance with yet a further embodiment of the present invention.
Figure 10B:
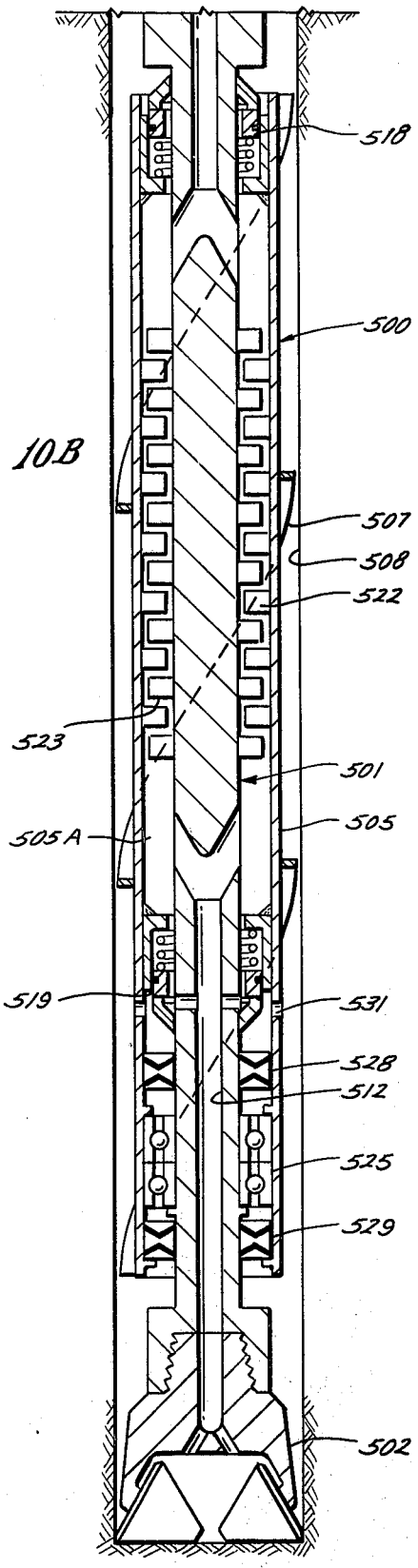

The tool constructed in accordance with the fifth embodiment of the invention, and indicated in FIGS. 10A and 10B by reference character 500, is similar to the drilling tool shown and described in U.S. Pat. No. 3,656,565. As in the previously described tools, it includes a shaft member 501 connected to a bit 502 at its lower end and having passageway means formed therein for circulating drilling fluid downwardly to the bit from a drill string 503 to which the upper end of the tool is connected. However, as compared with the previously described tool embodiments, the upper end of the shaft member is connected to the lower end of the drill string 503, and a pair of tubular members 504 and 505 are arranged concentrically about the upper and lower portions of the shaft member, respectively, so as to provide annular spaces 504A and 505A between the shaft member and tubular members, which form continuations of the passageway means through the shaft member.

As shown and described in the aforementioned patent, and as will be described more fully to follow, although the shaft member is fixed for rotation with the drill string, the tubular members 504 and 505 are supported from the shaft member by means of bearings 524 and 525 in the spaces 504A and 505A respectively, so that they may be rotated with respect thereto, and thus at greater speeds than the shaft member, by means of fluid motors mounted in the spaces. As in the case of the above-described turbodrills, these motors are operated by the circulation of drilling fluid therethrough, during its passage downwardly through the inner side of the tool, out the lower end of the bit and upwardly through the annulus between the outer side of the tool and the well bore 508. More particularly, spiral blades 506 and 507 are mounted on the outside of the rotating tubular members 504 and 505, respectively, so as to lift the drilling mud in the annulus and thereby facilitate drilling operations by reducing bottom hole pressure in the well bore.

The passageway means through the shaft member includes an upper portion 510 forming a downward continuation of the lower end of the drill string 503, an intermediate portion 511, and a lowermost portion 512 leading to the bore of bit 502. The lower end of the upper passageway portion 510 is connected by ports to the upper end of the upper annular space 504A between upper sleeve 504 and the shaft member, and the lower end of this space is connected by ports to the upper end of intermediate passageway portion 511. The lower end of passageway portion 511 is connected by ports with the upper end of the lower annular space 505A between lower sleeve 505 and the shaft member, and the lower end of such space is in turn connected by ports with the upper end of lower passageway portion 512.

Substantially all of the drilling fluid is confined for passage through the upper portions of the annular spaces by means of seals between the tubular members and shaft member at the upper and lower ends of the upper space portions. Thus, face seals 516 and 517, which may be similar to those previously described, are disposed within space 504A to seal between the shaft and tubular member 504 above and below the ports connecting with the space, and similar face seals 518 and 519 are disposed within space 505A to seal between the shaft member and tubular member 505 above and below the ports connected with such space.

As indicated in the drawings and as described in the aforementioned prior patent, the fluid motors for rotating the tubular members with respect to the shaft members comprise turbine blades on such members with the upper portions of the spaces between them. Thus, as shown, there are turbine blades 520 on the inner diameter of tubular member 504 and turbine blades 520 on the outer diameter of the upper end of the shaft member, and there are turbine blades 522 on the inner diameter of tubular member 505 and turbine blades 523 on the outer diameter of the lower end of the shaft member.

As in the case of the tool shown in the aforementioned patent, although only one tubular member may be provided about the shaft member, two sleeves are desired since they permit the torque on the tool to be at least substantially balanced. That is, as described in the prior patent, the turbine blades are so arranged as to cause the sleeves to rotate in opposite directions, and the spiral blades 506 and 507 are spiralled in opposite directions so that all blades have the effect of raising the drilling fluid in the annulus of the well bore.

As shown, bearings 524 are in the lower portion of annular space 504A beneath seal assembly 517, and the thrust bearings 525 are in the lower portion of the annular space 505A beneath seal assembly 519. Thus, seal assembly 517 separates the pressure of fluid in the upper portion of space 504A, and thus on the inner side of the tool, from that in the lower portion of such space. Similarly, seal assembly 519 separates the pressure of fluid in the upper portion of space 505A, and thus on the inner side of the tool, from that within the lower portion of such space.

In accordance with the improvements of the present invention, thrust bearings 524 and 525 are contained within lubricant chambers formed between sealing means disposed within the lower portions of the annular spaces above and below the thrust bearings. Thus, as shown, seal rings 526 and 527 are provided in the lower portion of space 504A to seal between the upper sleeve 504 and the shaft member above and below, respectively, thrust bearings 524, and seal rings 528 and 529 are provided in the lower portion of space 505A to seal between sleeve 505 and the shaft member above and below thrust bearings 525. Also, ports 530 are formed in tubular member 504 to connect the lower portion of space 504A between seal assembly 517 and seal ring 526 with the fluid on the outer side of the tool, and ports 531 are formed in tubular member 505 to connect the lower portion of space 505A between seal assembly 519 and seal ring 528 with fluid on the outer side of the tool. More particularly, and as in the first embodiment of the invention, the seal rings 526, 527, 528 and 529 are vertically slidable between the shaft member and the tubular members.

Thus, each of the seal assemblies 516 to 519 separates fluid on the inner side of the tool from that on the outer side thereof, so as to contain the pressure differential thereacross. At the same time, the seal rings 526 to 529 separate lubricant within the lubricant chambers from fluid on the outer side of the tool, so that with the sliding seal rings free to vary the volume of the lubricant chambers as outside pressure changes, or as lubricant is lost, lubricant pressure is maintained substantially equal to that on the outer side of the tool.

From the foregoing, it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A well drilling tool adapted to be connected to the lower end of a drill string above the drill bit, whereby drilling fluid may be circulated downwardly through the inside of the tool and upwardly within the annulus between the outside of the tool and the bore of the well being drilled, comprising inner and outer members defining an annular space therebetween, means on the members within said space supporting them for rotation with respect to one another, first means sealing between said members for separating the fluid on one side of said tool from that within a portion of said space, means providing a variable volume lubricant chamber including second and third sealing means between said members within the space portion, and means fluidly connecting the other side of the tool with said space portion above and below said second and third sealing means, respectively, whereby said first seal means is adapted to contain the pressure differential between the inner and outer sides of the tool, and said second and third sealing means separate the part of the chamber between them from the fluid on said other side of the tool, the volume of said chamber being variable in response to changes in the pressure of fluid on said other side of the tool near said chamber, so as to maintain the pressure of lubricant within the chamber substantially equal to that on said other side of the tool, and thereby protect parts contained within said chamber for said drilling fluid.

2. A well drilling tool of the character defined in claim 1, wherein said first sealing means is below the second and third sealing means to separate the fluid on the outer side of the tool from said space portion, and said connecting means fluidly connects said space portion with the inner side of said tool.

3. A well drilling tool of the character defined in claim 1, wherein said first sealing means is above the second and third sealing means to separate the fluid on the inner side of the tool from said space portion, and said connecting means fluidly connects said space portion to the outer side of the tool.

4. A well drilling tool of the character defined in claim 1, wherein the supporting means is contained within said chamber.

5. A well drilling tool of the character defined in claim 1, including a means on the members for rotating them with respect to one another, said rotating means being contained within said chamber.

6. A well drilling tool of the character defined in claim 1, wherein one of the inner or outer members comprises a shaft member having means for connection to the bit, and the other of the inner or outer members comprising a tubular member having means for connecting it to the lower end of the drill string.

7. A well drilling tool of the character defined in claim 6, wherein said shaft member is the inner member, and said tubular member in the outer member.

8. A well drilling tool of the character defined in claim 1, wherein one of the inner and outer members comprises a shaft member having means on its opposite ends for connection to the lower end of the drill string and the bit, and the other of the inner and outer members is a tubular member disposed about the shaft member and carries helical blades arranged thereabout to lift drilling fluid in the annulus.

9. A well drilling tool of the character defined in claim 1, wherein at least one of said second and third sealing means comprises a seal ring which is vertically slidable within said space portion to permit the volume of said chamber to vary.

10. A well drilling tool of the character defined in claim 1, wherein said means providing a chamber includes an expandible and contractible bellows fluidly connected with the part of the chamber between the second and third sealing means.

11. A well drilling tool of the character defined in claim 1, wherein said means providing a chamber includes passageway means within one of the inner and outer members fluidly connected at one end with said other side of the tool, and piston means sealably slidable within the passageway means.

12. A well drilling tool adapted to be connected to the lower end of a drill string above the drill bit, whereby drilling fluid may be circulated downwardly through the inside of the tool and upwardly within the annulus between the outside of the tool and the bore of the well being drilled, comprising a shaft member having means thereon for connecting it to the bit, a tubular member arranged concentrically of the shaft member to provide an annular space therebetween, means on the members within said space supporting one of the shaft and tubular members from the other of the shaft and tubular members for rotation with respect thereto, means on said other of the shaft and tubular members for connecting it to the lower end of the drill string, first means sealing between said members for separating the fluid on one side of said tool from that within a portion of said space, means providing a lubricant chamber including second and third sealing means between said members within the space portion, and means fluidly connecting the other side of the tool with said space portion above and below said second and third sealing means, respectively, whereby said first seal member is adapted to contain the pressure differential between the inner and outer sides of the tool, and said second and third sealing means separate the part of the chamber between them from the fluid on said other side of the tool, said means providing the chamber including means for varying its volume in response to changes in the pressure of fluid on said other side of the tool near said chamber, so as to maintain the pressure of lubricant within the chamber substantially equal to that on said other side of the tool, and thereby protect parts contained within said chamber from said drilling fluid.

13. A well drilling tool of the character defined in claim 12, wherein said first sealing means is below said third sealing means to separate the fluid on the outer side of the tool from said space portion, and said fluidly connecting means fluidly connects said space portion with the inner side of the tool.

14. A well drilling tool of the character defined in claim 12, wherein said first sealing means is above the second and third sealing means to separate the fluid on the inner side of the tool from said space portion, and said fluidly connecting means fluidly connects said space portion to the outer side of the tool.

15. A well drilling tool of the character defined in claim 13, wherein the supporting means is contained within said chamber.

16. A well drilling tool of the character defined in claim 12, including a means on the members for rotating them with respect to one another, said rotating means being contained within said chamber.

17. A well drilling tool of the character defined in claim 12, wherein said shaft member is supported from the tubular member, and said tubular member has means thereon for connecting it to the drill string.

18. A well drilling tool of the character defined in claim 17, wherein the shaft member is within the tubular member.

19. A well drilling tool of the character defined in claim 12, wherein said shaft member has means on its upper end for supporting it from the drill string and means on its lower end for connection to the bit, and said tubular member is arranged concentrically about the shaft member and carries helical blades arranged thereabout to lift drilling fluid in the annulus.

20. A well drilling tool of the character defined in claim 12, wherein at least one of said second and third sealing means comprises a seal ring which is vertically slidable within said space portion to permit the volume of said chamber to vary.

21. A well drilling tool of the character defined in claim 12, wherein said means providing a chamber includes an expandible and contractible bellows disposed within said space portion and fluidly connected with the part of the chamber between the second and third sealing means.

22. A well drilling tool of the character defined in claim 12, wherein said means providing a chamber includes passageway means within one of the shaft and tubular members fluidly connected at one end with said other side of the tool, and piston means sealably slidable within the passageway means.

23. A well drilling tool adapted to be connected to the lower end of a drill string above the drill bit, whereby drilling fluid may be circulated downwardly through the inside of the tool and upwardly within the annulus between the outside of the tool and the bore of the well being drilled, comprising a shaft member having means thereon for connecting it to the bit, a tubular member arranged about the shaft member to provide an annular space therebetween, means on the tubular member for connecting it to the lower end of the drill string, means on the members within said space supporting the shaft member from the tubular member for rotation with respect thereto, first means sealing between said members for separating the fluid on one side of said tool from that within a portion of said space, means providing a lubricant chamber including second and third sealing means between said members within the space portion above and below the supporting means, and means fluidly connecting the other side of the tool with said space portion above and below said second and third sealing means, respectively, whereby said first seal means is adapted to contain the pressure differential between the inner and outer sides of the tool, and said second and third sealing means separate the part of the chamber between them from the fluid on said other side of the tool, said means providing the chamber including means for varying its volume in response to changes in the pressure of fluid on said other side of the tool near said chamber, so as to maintain the pressure of lubricant within the chamber substantially equal to that on said other side of the tool, and thereby protect parts contained within said chamber from said drilling fluid.

24. A well drilling tool of the character defined in claim 23, wherein said first sealing means is below said third sealing means to separate the fluid on the outer side of the tool from said space portion, and said fluidly connecting means fluidly connects said space portion with the inner side of the tool.

25. A well drilling tool of the character defined in claim 23, wherein said first sealing means is above the second and third sealing means to separate the fluid on the inner side of the tool from said space portion, and said fluidly connecting means fluidly connects said space portion to the outer side of the tool.

26. A well drilling tool adapted to be connected to the lower end of a drill string above the drill bit, whereby drilling fluid may be circulated downwardly through the inside of the tool and upwardly within the annulus between the outside of the tool and the bore of the well being drilled, comprising a shaft member having means thereon for connecting it to the bit, a tubular member arranged about the shaft member to provide an annular space therebetween, means on the tubular member for connecting it to the lower end of the drill string, means on the members within said space supporting the shaft member from the tubular member for rotation with respect thereto, first means sealing between said members above the supporting means for separating the fluid on the inner side of said tool from that within a portion of said space, means providing a lubricant chamber including second and third sealing means between said members within the space portion above and below the supporting means, and means fluidly connecting the outer side of the tool with said space portion above and below said second and third sealing means, respectively, whereby said first seal means is adapted to contain the pressure differential between the inner and outer sides of the tool, and said second and third sealing means separate the part of the chamber between them from the fluid on said outer side of the tool, said means providing the chamber also including an annular passageway within the shaft member fluidly connected at its lower end with said outer side of the tool, and an annular piston sealably slidable within the passageway for varying the volume of said chamber in response to changes in the pressure of fluid on said outer side of the tool near said chamber, so as to maintain the pressure of lubricant within the chamber substantially equal to that on said outer side of the tool, and thereby protect the supporting means contained within said chamber from said drilling fluid.

27. A well drilling tool of the character defined in claim 1, wherein there is a first annular passageway through another portion of the annular space, said inner member includes a tubular section which has a bore therein fluidly connected with the first annular passageway, said members have means thereon within the first annular passageway for causing relative rotation between said members in response to the circulation of said drilling fluid therethrough, there is a second annular passageway within said space through which a portion of the drilling fluid is circulated, and the lower end of said second annular passageway is closed by the first sealing means so that said first sealing means is cooled by the circulation of drilling fluid therepast.

28. A well drilling tool of the character defined in claim 27, wherein the upper end of said second passageway is fluidly connected to the lower end of the first passageway.

29. A well drilling tool of the character defined in claim 12, wherein there is a first annular passageway through another portion of the annular space, said inner member includes a tubular section which has a bore therein fluidly connected with the first annular passageway, said members have means thereon within the first annular passageway for causing relative rotation between said members in response to the circulation of said drilling fluid therethrough, there is a second annular passageway within said space through which a portion of the drilling fluid is circulated, and the lower end of said second annular passageway is closed by the first sealing means so that said first sealing means is cooled by the circulation of drilling fluid therepast.

30. A well drilling tool of the character defined in claim 29, wherein the upper end of said second passageway is fluidly connected to the lower end of the first passageway.

31. A well drilling tool of the character defined in claim 23, wherein there is a first annular passageway through another portion of the annular space, said inner member includes a tubular section which has a bore therein fluidly connected with the first annular passageway, said members have means thereon within the first annular passageway for causing relative rotation between said members in response to the circulation of said drilling fluid therethrough, there is a second annular passageway within said space through which a portion of the drilling fluid is circulated, and the lower end of said second annular passageway is closed by the first sealing means so that said first sealing means is cooled by the circulation of drilling fluid therepast.

32. A well drilling tool of the character defined in claim 31, wherein the upper end of said second passageway is fluidly connected to the lower end of the first passageway.

33. A well drilling tool of the character defined in claim 1, wherein said first sealing means comprises a seal ring carried by and rotatable with each member, each seal ring having a hard surface which is sealably slidable over the hard surface of the other seal ring during relative rotation of said members.

34. A well drilling tool of the character defined in claim 12, wherein said first sealing means comprises a seal ring carried by and rotatable with each member, each seal ring having a hard surface which is sealably slidable over the hard surface of the other seal ring during relative rotation of said members.

35. A well drilling tool of the character defined in claim 23, wherein said first sealing means comprises a seal ring carried by and rotatable with each member, each seal ring having a hard surface which is sealably slidable over the hard surface of the other seal ring during relative rotation of said members.

36. A well drilling tool of the character defined in claim 27, wherein said first sealing means comprises a seal ring carried by and rotatable with each member, each seal ring having a hard surface which is sealably slidable over the hard surface of the other seal ring during relative rotation of said members.

37. A well drilling tool of the character defined in claim 29, wherein said first sealing means comprises a seal ring carried by and rotatable with each member, each seal ring having a hard surface which is sealably slidable over the hard surface of the other seal ring during relative rotation of said members.

38. A well drilling tool of the character defined in claim 31, wherein said first sealing means comprises a seal ring carried by and rotatable with each member, each seal ring having a hard surface which is sealably slidable over the hard surface of the other seal ring during relative rotation of said members.

* * * * *